US008678249B2

(12) United States Patent
Gaus

(10) Patent No.: US 8,678,249 B2
(45) Date of Patent: Mar. 25, 2014

(54) VALVE MOUNTING ASSEMBLY WITH SLIT MISALIGNMENT PREVENTION FEATURE

(75) Inventor: David J. Gaus, Saginaw, MI (US)

(73) Assignee: AptarGroup, Inc., Crystal Lake, IL (US)

( * ) Notice: Subject to any disclaimer, the term of this patent is extended or adjusted under 35 U.S.C. 154(b) by 1507 days.

(21) Appl. No.: 12/070,799

(22) Filed: Feb. 21, 2008

(65) Prior Publication Data

US 2009/0212078 A1 Aug. 27, 2009

(51) Int. Cl.
*B65D 5/72* (2006.01)

(52) U.S. Cl.
USPC ..... 222/501; 222/490; 222/494; 222/499

(58) Field of Classification Search
USPC ..... 222/490, 492, 494, 499, 181.1–181.2, 222/185.1, 501, 559
See application file for complete search history.

(56) References Cited

U.S. PATENT DOCUMENTS

| | | | | |
|---|---|---|---|---|
| 4,749,108 | A | 6/1988 | Dornsbusch et al. | |
| 4,909,798 | A | 3/1990 | Fleischhacker et al. | |
| 5,213,236 | A | 5/1993 | Brown et al. | |
| 5,271,531 | A | 12/1993 | Rohr et al. | |
| 5,297,599 | A * | 3/1994 | Bucheli | 141/329 |
| 5,339,995 | A | 8/1994 | Brown et al. | |
| 5,377,877 | A | 1/1995 | Brown et al. | |
| 5,409,144 | A | 4/1995 | Brown | |
| 5,439,143 | A | 8/1995 | Brown et al. | |
| 5,676,289 | A | 10/1997 | Gross et al. | |
| 6,062,435 | A | 5/2000 | Hess, III | |
| 6,062,436 | A * | 5/2000 | Fuchs | 222/212 |
| 6,065,642 | A | 5/2000 | Brown | |

(Continued)

FOREIGN PATENT DOCUMENTS

| | | |
|---|---|---|
| CN | 1267269 A | 9/2000 |
| EP | 0 947 440 A1 | 10/1999 |
| WO | WO 99/10247 | 3/1999 |

OTHER PUBLICATIONS

Figs. 1-9 on sheets 1, 2, 3, 4, 5, and 6 of 6 showing prior art features.

(Continued)

*Primary Examiner* — Frederick C Nicolas
(74) *Attorney, Agent, or Firm* — Wood, Phillips, Katz, Clark & Mortimer

(57) ABSTRACT

A mounting system is provided for mounting a valve for accommodating the flow of fluent a substance from a supply of the fluent substance wherein the valve includes a peripheral attachment portion, an intermediate portion extending from the peripheral attachment portion, and a flexible, resilient head that extends from the intermediate portion and that has (a) a first side, (b) a second side, (c) at least one self-sealing slit through the head, (d) a laterally marginal portion adjacent the intermediate portion, and (e) confronting, openable portions along the slit to define an initially closed orifice. The mounting system includes a retention structure for engaging holding the valve and includes an abutment structure. The abutment structure is adapted to be disposed adjacent the valve intermediate portion so that the abutment structure can be engaged by the valve head first side at the laterally marginal portion of the valve head to limit movement of the laterally margin portion of the valve head in one direction.

5 Claims, 10 Drawing Sheets

(56) References Cited

U.S. PATENT DOCUMENTS

| | | | | |
|---|---|---|---|---|
| 6,112,951 | A | 9/2000 | Mueller | |
| 6,112,952 | A | 9/2000 | Hess, III et al. | |
| 6,131,806 | A | 10/2000 | Hess, III et al. | |
| 6,293,437 | B1 * | 9/2001 | Socier et al. | 222/212 |
| 6,616,016 | B2 | 9/2003 | Hicks et al. | |
| 6,951,295 | B1 | 10/2005 | Gaus et al. | |
| 2006/0249536 | A1 | 11/2006 | Hartman et al. | |
| 2007/0114250 | A1 * | 5/2007 | Langseder et al. | 222/494 |
| 2008/0035677 | A1 | 2/2008 | Daansen | |
| 2008/0237278 | A1 | 10/2008 | Gaus et al. | |

OTHER PUBLICATIONS

International Search Report and Written Opinion of the International Searching Authority, or the Declaration dated Mar. 18, 2009 for the international patent application PCT/US2009/00501 claiming priority of the above-captioned instant U.S. Appl. No. 12/070,799.

Chinese Office Action dated Jul. 1, 2011 (and English translation).

Communication dated Feb. 26, 2013 received from the European Patent Office enclosing the extended European Search Report for the European application No. 09712129.7.

* cited by examiner

FIG. 3
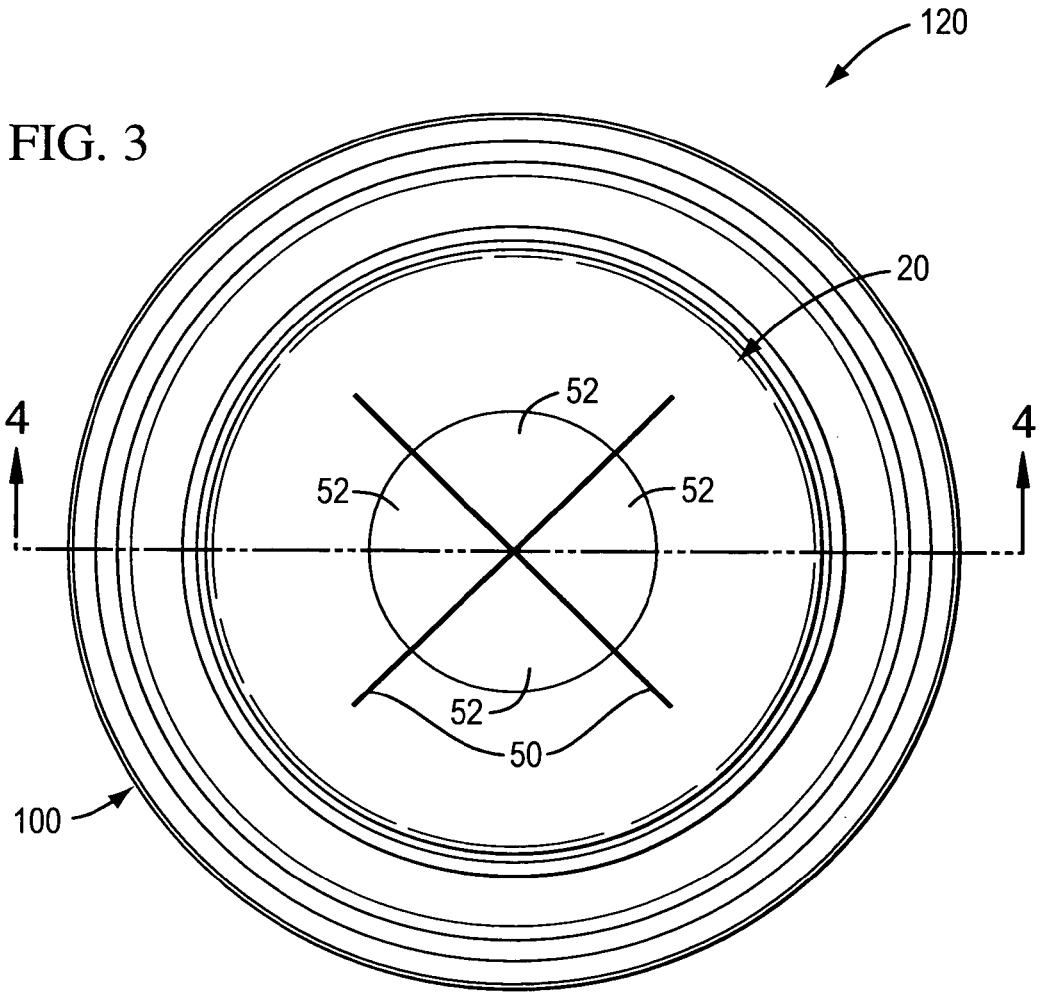
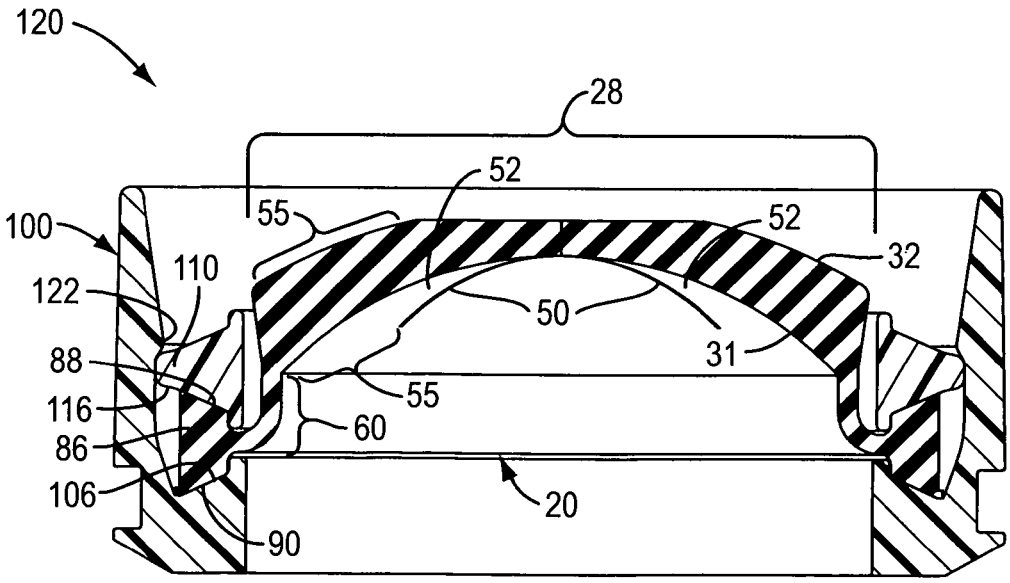
FIG. 4

FIG. 12
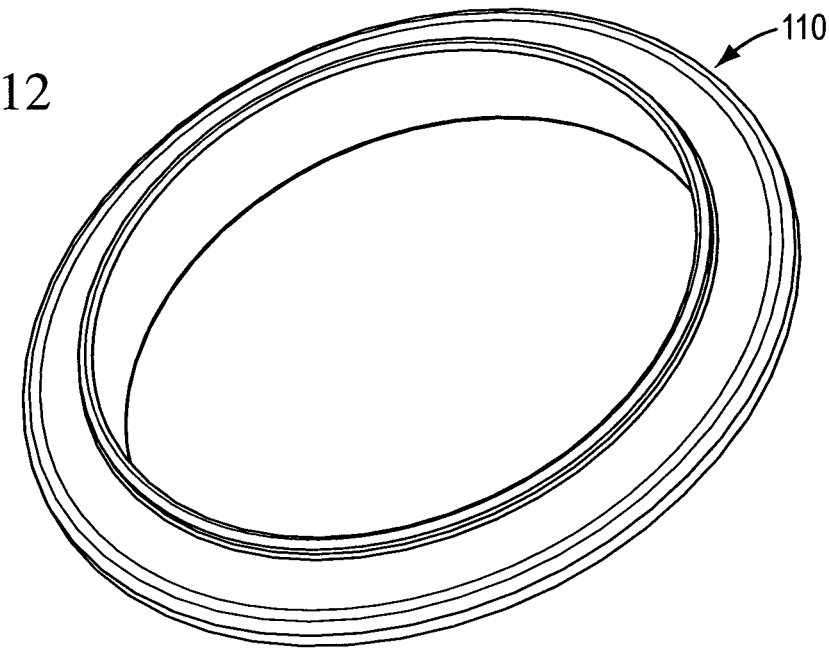
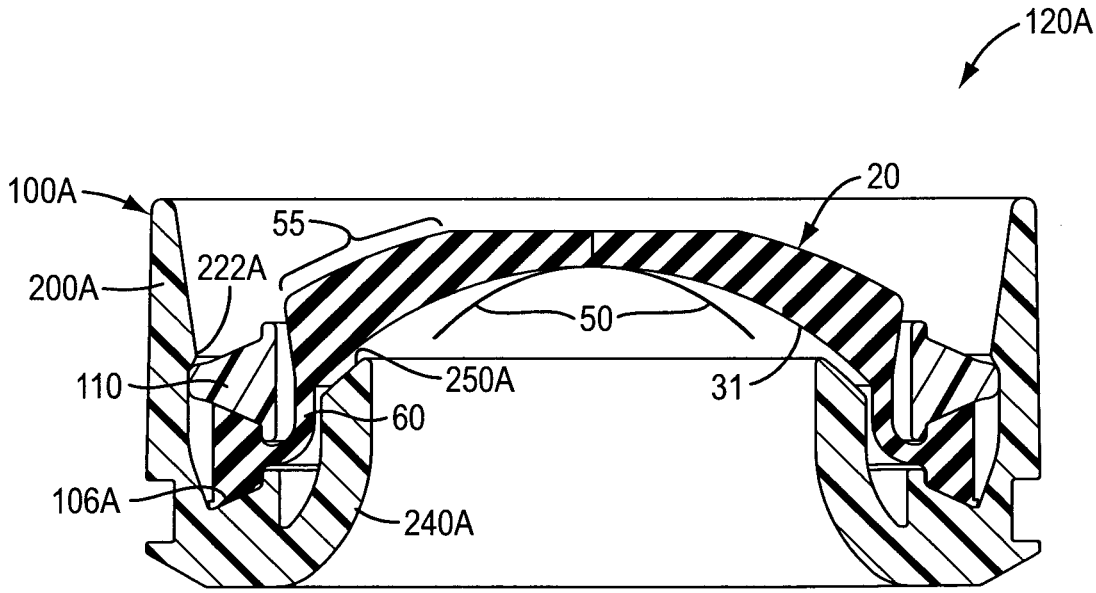
FIG. 13

VALVE MOUNTING ASSEMBLY WITH SLIT MISALIGNMENT PREVENTION FEATURE

TECHNICAL FIELD

The present invention relates generally to a system for accommodating the flow of a fluent substance. The invention more particularly relates to a system for holding or mounting a flexile, resilient valve and accommodating the flow of the fluent substance through the valve.

BACKGROUND OF THE INVENTION AND TECHNICAL PROBLEMS POSED BY THE PRIOR ART

The inventor of the present invention has discovered that it would be advantageous to provide an improved system for retaining or otherwise mounting a flexible, resilient valve defining an initially closed orifice which can be opened to accommodate fluid flow through the valve, wherein the design of the system could provide advantages not heretofore contemplated in the industry or suggested by the prior art. In particular, the system of the present invention facilitates proper closing of the valve after portions of the valve have been forced away from their initially closed configuration.

SUMMARY OF THE INVENTION

The inventor of the present invention has invented an innovative valve mounting system which, inter alia, can provide an improved closing operation of the valve.

The inventor of the present invention has discovered that the valve mounting system can optionally be designed to incorporate multiple components that can easily accommodate assembly by the manufacturer.

Also, the valve mounting system can optionally be provided with a design that accommodates efficient, high quality, large volume manufacturing techniques with a reduced product reject rate.

According to one aspect of the invention, a mounting system is provided for mounting a valve for accommodating the flow of a fluent substance from a supply of the substance wherein the valve includes (1) a peripheral attachment portion, (2) a flexible, resilient, intermediate portion extending from the peripheral attachment portion, and (3) a flexible, resilient head extending from the intermediate portion. The valve head has (a) a first side, (b) a second side and (c) at least one self-sealing slit through the head, (d) a laterally marginal portion adjacent the intermediate portion, and (e) confronting, openable portions along the slit to define an initially closed orifice wherein the valve head openable portions can move generally in a first direction to an open configuration and wherein the valve head openable portions can also move generally in a second direction opposite the first direction to an open configuration.

The mounting system of the invention comprises (a) a retention structure for engaging and holding the valve peripheral attachment portion of the valve, and (b) an abutment structure for being disposed adjacent the valve intermediate portion to be engaged by the valve head first side at the laterally marginal portion of the valve head to limit movement of the laterally marginal portion of the valve head in the second direction.

It has been found that the abutment structure prevents excessive movement a laterally marginal portion of the valve head in one direction, and this reduction in the allowable movement of at least part of the valve head permits the valve head to move back in the generally opposite direction to the fully closed position with little or no misalignment of valve head openable portions that are adjacent the slit.

The mounting system of the present invention is particularly suitable for mounting a valve in dispensing apparatus wherein relative movement between the valve and an inserted conduit or probe causes portions of the valve head to open to accept the probe so that the probe extends through the valve. In one particular use of the invention, such a probe is a water outlet conduit employed in a water dispenser or water cooler of the type wherein a container of water is inverted and mounted on a base unit containing such a conduit. In such a use of the mounting system of the present invention, the mounting system functions to mount a valve in the discharge opening of the water container so as to permit the inverted water container to be installed on the water cooler base with the probe extending upwardly from the base into and through the valve in the discharge opening of the water container.

The valve mounting system of the present invention can be positioned relative to an associated container (or other structure containing a fluent substance) by various arrangements. In particular, the valve mounting system may be permanently or releasably attached to the container (or other structure containing a fluent substance). The valve, per se, which is not part of the valve mounting system, per se, of the invention, can be provided in a form which is initially separate from, but subsequently attachable to or retained within, the valve mounting system of the invention.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

FIG. 3 is a top, plan view of the valve illustrated in FIGS. 1 and 2 shown disposed in a mounting system that incorporates features of the prior art;

FIG. 4 is a cross-sectional view taken generally along the plane 4-4 in FIG. 3;

FIG. 12 is a retainer ring that can be employed with the housing illustrated in FIGS. 10 and 11;

FIG. 13 is a cross-sectional view of the valve shown installed in one form of the mounting system of the present invention wherein the mounting system incorporates the housing illustrated in FIGS. 10 and 11 and the retainer ring illustrated in FIG. 12;

FIG. 14 shows the valve and mounting system being moved downwardly along the probe illustrated in FIGS. 5 and 6.

DESCRIPTION OF THE PREFERRED EMBODIMENTS

While this invention is susceptible of embodiment in many different forms, this specification and the accompanying drawings disclose only one specific form as an example of the invention. The invention is not intended to be limited to the embodiment so described, however. The scope of the invention is pointed out in the appended claims.

As discussed in detail hereinafter, the valve mounting system of the present invention can be used to mount a valve in a fluid handling system, including in an associated container or other dispensing structure so as to accommodate transfer of fluent substances including, but not limited to, water.

Notably, the present invention mounting system is especially suitable for use with, but is not limited to, the type of flexible, resilient valve that includes a so-called rolling sleeve which operatively connects a peripheral attachment portion of the valve with a central valve head (which is openable in either of two opposite directions).

For ease of description, many of the figures illustrating the invention show one form of a valve held in one embodiment of the present invention mounting system in one typical orientation that the mounting system may have in a particular application, and terms such as upper, lower, horizontal, etc., are used with reference to this orientation. It will be understood, however, that the mounting system of this invention may be manufactured, stored, transported, sold, and used in an orientation other than the orientation described.

The mounting system of the present invention may be used with a variety of conventional or special fluent substance handling and/or holding systems, including glass or plastic bottles, flexible tubular containment structures, containers, tanks, vessels, and other equipment or apparatus, the details of which, although not fully illustrated or described, would be apparent to those having skill in the art and an understanding of such systems. The particular fluent substance handling or holding system, per se, forms no part of, and therefore is not intended to limit, the broad aspects of the present invention. It will also be understood by those of ordinary skill that novel and non-obvious inventive aspects are embodied in the described exemplary valve mounting system alone.

Figure 1:
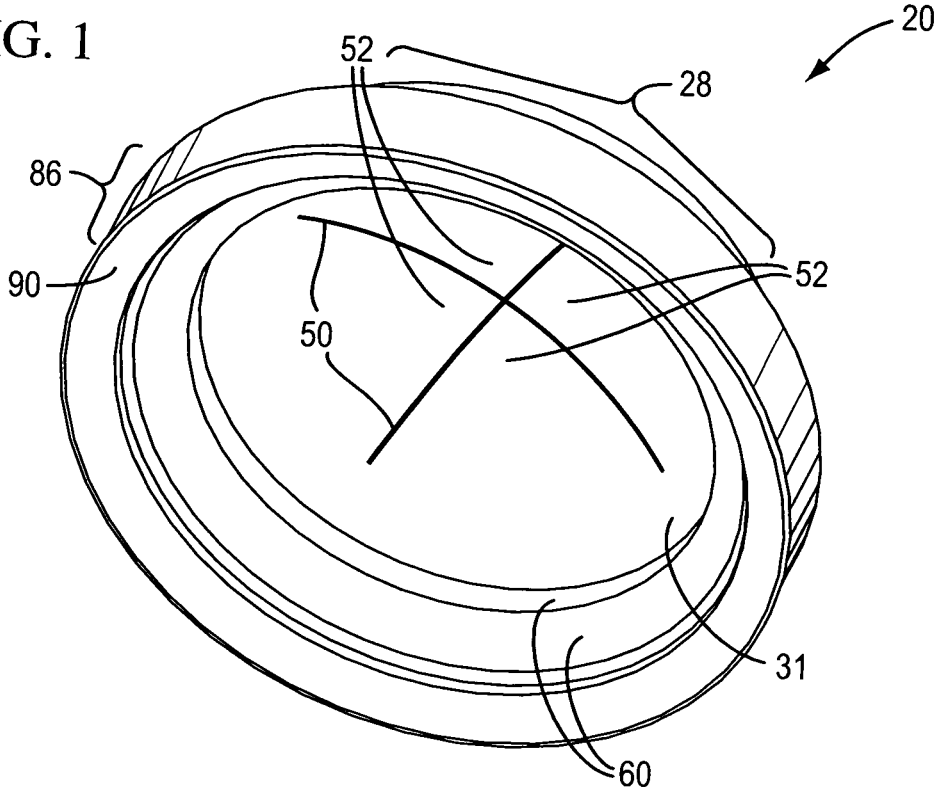
FIG. 1 is an isometric view of one form of a valve that can be retained in a mounting system of the present invention, and the valve is shown in an as-molded unactuated, closed, rest configuration as viewed from above prior to installation in an embodiment of the mounting system of the present invention.

A valve which can be retained in the mounting system of the present invention is illustrated in FIGS. 1-4 and 7-9 and is designated generally by reference number 20 in many of those figures (e.g., in FIG. 1). The valve 20 is suitable for cooperation with mounting system components of the present invention that are initially provided and assembled with the valve 20 to create a dispensing system subassembly (described in detail hereinafter with reference to FIGS. 10-15). Such a subassembly can be subsequently installed on a bottle or other container (not shown) that contains a substance to be dispensed. The illustrated form of the valve 20 is particularly suitable for discharging a flowable, liquid substance such as water.

The valve 20 is a self-closing, slit-type valve. The valve 20 is preferably molded as a unitary structure from material which is flexible, pliable, elastic, and resilient. This can include elastomers, such as a synthetic, thermosetting polymer, including silicone rubber, such as the silicone rubber sold by Dow Corning Corp. in the United States of America under the trade designation D.C. 99-595-HC. Another suitable silicone rubber material is sold in the United States of America under the designation Wacker 3003-40 by Wacker Silicone Company. Both of these materials have a hardness rating of 40 Shore A. The valve 20 could also be molded from other thermosetting materials or from other elastomeric materials, or from thermoplastic polymers or thermoplastic elastomers, including those based upon materials such as thermoplastic propylene, ethylene, urethane, and styrene, including their halogenated counterparts.

The valve 20 has the configuration of a commercially available valve substantially as disclosed in the U.S. Pat. No. 5,676,289 with reference to the valve 46 disclosed in the U.S. Pat. No. 5,676,289. Such a type of commercially available valve is further described with reference to the similar valve that is designated by reference number 3d in the U.S. Pat. No. 5,409,144. The descriptions of those two patents are incorporated herein by reference thereto to the extent pertinent and to the extent not inconsistent herewith.

The valve 20 has an initially closed, substantially unstressed, rest position or configuration (FIGS. 1-4). The valve 20 can be forced to one or more open positions or configurations (FIGS. 7 and 8) when a sufficiently high force acts on the valve 20 as described hereinafter. The valve 20 includes a flexible, central portion or head 28 (FIGS. 1, 2, and 4) with a first side 31 and a second side 32. When the valve 20 is closed, the head 28 has an inwardly concave configuration (as viewed from the exterior of the valve first side 31 in FIGS. 1 and 4).

Figure 2:
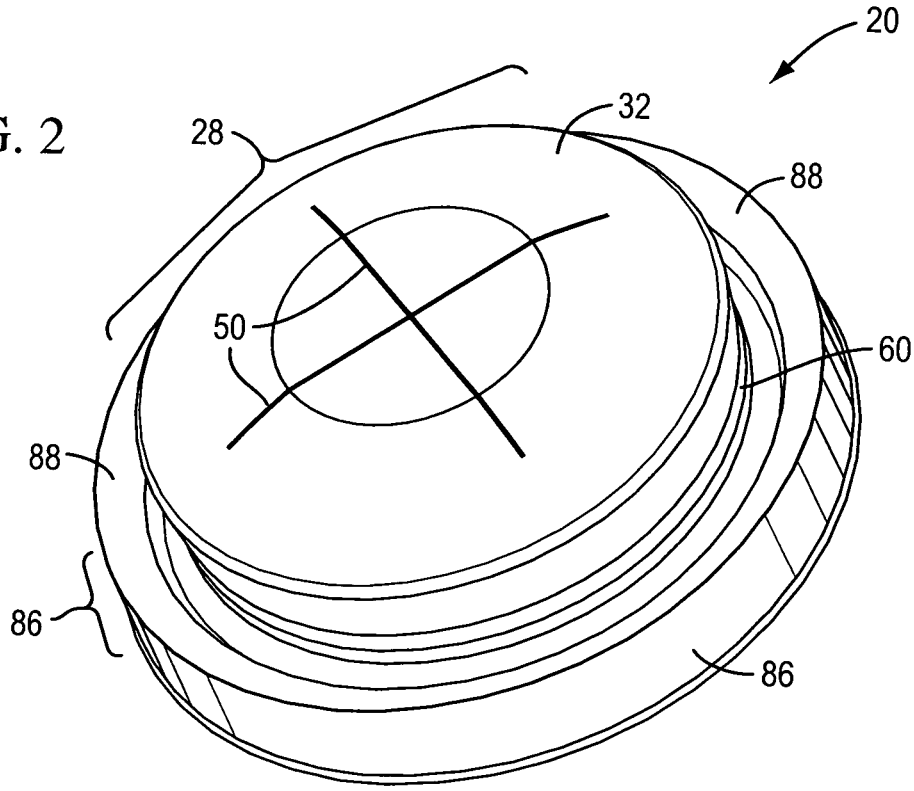
FIG. 2 is an isometric view of the valve shown in FIG. 1, but in FIG. 2, the valve is viewed from above rather than below as in FIG. 1.
Figure 5:
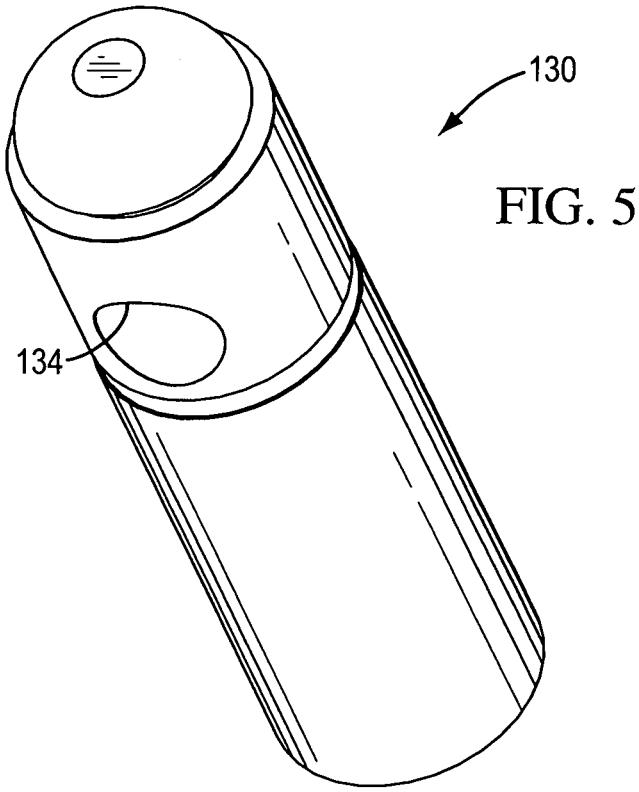
FIG. 5 is a view of a probe which is in the form of a conduit for liquid and which can be employed to transfer a fluent substance, such as a liquid or gas, from one location to another location.
Figure 6:
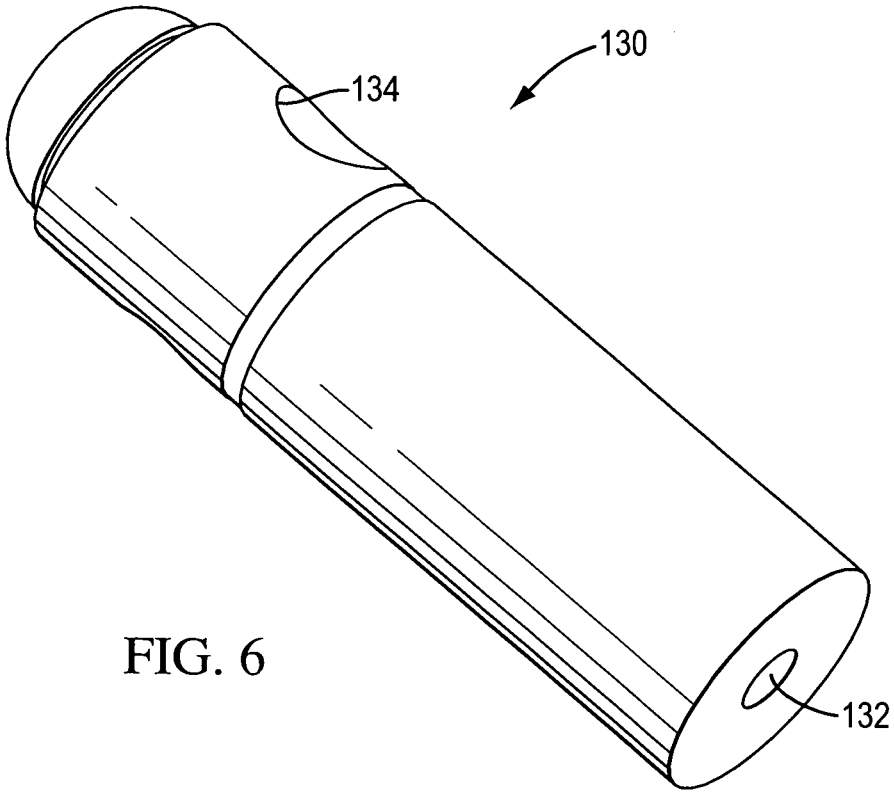
FIG. 6 is an isometric view of the probe illustrated in FIG. 5, but in FIG. 6, the probe is viewed from a different angle than in FIG. 5.

As can be seen FIG. 2, the head 28 preferably has planar, intersecting, dispensing slits 50 of equal length which together define a closed orifice when the valve 20 is closed. In the preferred form of the valve 20, there are two intersecting slits 50 (FIG. 1) oriented at equal angles of intersection to define four, generally sector-shaped, equally sized flaps or petals 52 in the concave, central head 28. The flaps or petals 52 may be also characterized as "openable regions" or "openable portions" of the valve head 28. Each flap or petal 52 has a pair of diverging transverse faces defined by the slits 50, and each transverse face seals against a confronting transverse face of an adjacent petal 52 when the valve 20 is closed.

The valve 20 can be molded with the slits 50. Alternatively, the valve slits 50 can be subsequently cut into the central head 28 of the valve 20 by suitable conventional techniques. In operation, the petals 52 can be forced open outwardly (upwardly in FIGS. 4 and 7) from the intersection point of the slits 50 when a sufficiently force (or pressure differential) is applied to the first side 31 of the valve head 28.

The valve head 28 may also be characterized as having a laterally marginal portion 55 (FIG. 4) at the outer periphery of the valve head 28. In the particular valve 28 illustrated, the marginal portion 55 is thicker than the center of the valve head 28.

The valve 20 includes an annular, intermediate portion, such as a sleeve 60 (FIGS. 2 and 4), which extends from the outer edge of the valve head laterally marginal portion 55 (i.e., the intermediate portion or sleeve 60 extends from the periphery of the valve head 28). The sleeve 60 initially extends longitudinally from the valve head 28, and then the sleeve 60 extends generally radially outwardly and joins with an enlarged, much thicker, peripheral flange 86 which has a generally dovetail-shaped, transverse cross section (as viewed in FIG. 4).

To accommodate mounting and retention of the valve 20 as described hereinafter, the dovetail valve flange 86 has a top surface 88 (FIGS. 2 and 4) oriented to define a frustoconical configuration. Further, the flange 86 has a downwardly facing bottom surface 90 (FIGS. 1 and 4) which also has a frustoconical, annular configuration.

As illustrated in FIGS. 3 and 4, the valve 20 can be conventionally mounted in a housing 100 which includes an annular seat 106 for matingly engaging the downwardly facing, frustoconical surface 90 of the valve flange 86. As can be seen in FIG. 4, the subassembly includes a retainer ring 110 which has a downwardly facing clamping surface 116 which is adapted to matingly engage, and clamp against, the upwardly facing frustoconical surface 88 of the valve flange 86. The lateral edge of the retainer ring 110 can be maintained in snap-fit engagement with an annular bead 122 that is located on the inside of the housing 100 above the housing annular seat 106. The snap-fit engagement of the retainer ring 110 within the housing 100 causes the ring 110 to clamp the valve 20 tightly in the housing 100. The assembled combination of the valve 20, housing 100, and retainer ring 110 may be defined as a subassembly 120.

During assembly, the retainer ring 110 can be pushed past the housing retaining bead 122 because there is sufficient flexibility in the retainer ring 110 and/or housing 100 to accommodate temporary, elastic deformation of the components as the retainer ring 110 passes over, and inwardly beyond, the housing bead 122 to create a snap-fit engagement between the retainer ring 110 and housing 100 such that the valve flange 86 is compressed slightly and clamped between the opposing frustoconical surfaces 106 and 116 (FIG. 4). This permits the region inside the valve sleeve 60 to be substantially free and clear. The valve 20, the housing 100, and the retainer ring 110, in so far as they have been described, embody conventional features known in the prior art. The valve 20 could have other configurations, such as a different shape for the mounting flange 86. Also, in some other arrangements, the valve 20 could be held in a housing without a retainer ring. For example, the valve could be held in the housing by heat bonding, swaging of a wall of the housing over the valve flange, adhesive, press fit, etc.

The valve 20 is typically employed in applications wherein the valve 20 is mounted in or to a fluent substance dispensing system, such as a bottle or container, for dispensing or discharging a fluent substance through the valve 20 when a sufficient pressure differential is applied across the valve head 28 to open the valve. Typically, the valve 20 is oriented at the opening of a container holding a fluent substance such that the valve head first side 31 faces outwardly toward the exterior ambient environment and such that the valve head second side 32 faces inwardly toward the container interior and interfaces with the fluent substance within the container. With reference to FIG. 4, the typical operation of such a valve 20 involves the user first tipping the container to orient the valve 20 as shown in FIG. 4 and then applying a pressure differential to the valve head 28 (as by sucking on the exterior side of the valve and/or by squeezing a flexible wall or walls of the container). This causes the valve 20 to open (outwardly or downwardly with reference to FIG. 4).

As the valve 20 opens, the outward displacement of the central head 28 of the valve 20 is accommodated by, inter alia, deformation of the relatively thin, flexible sleeve 60. The sleeve 60 deforms, or moves, from an inwardly projecting, retracted, rest position (shown in FIG. 4) to an outwardly displaced (i.e., extended), actuated position, and this occurs by the sleeve 60 "rolling" along itself outwardly toward the bottom end of the housing 100. When the sleeve 60 rolls to its fully extended position, the valve 20 opens in the conventional manner (as described in detail in the above-identified U.S. Pat. No. 5,676,289 with reference to valve 46 as described in that patent). As the valve 20 opens, the valve head openable portions or petals 52 may be characterized as moving in a direction toward and to an open configuration.

The valve 20 is typically designed to close when the pressure differential across the valve head 28 drops below a predetermined amount. The inherent resiliency of the valve 20 allows the valve 20 to return to the unactuated, closed condition (by action of the force generated from the resilient valve's deformational stresses). The valve 20 is sufficiently stiff so that it remains closed under the weight or static head of the substance in the container bearing against the valve second side 32, but the valve 20 is flexible enough to open when the valve head 28 is subjected to an increased pressure differential greater than a predetermined magnitude.

The valve 20 is also typically designed to be flexible enough for use in various applications where it is necessary or desirable to accommodate in-venting of ambient atmosphere. To this end, as the valve 20 closes, the closing petals or openable portions 52 of the valve 20 can continue moving inwardly past the closed position to allow the valve petals 52 to open inwardly when the pressure on the valve head exterior surface (first side 31) exceeds the pressure on the valve head interior surface (second side 32) by a predetermined magnitude. Such in-venting of the ambient atmosphere helps equalize the interior pressure in the container with the pressure of the exterior ambient atmosphere. Such an in-venting capability can be provided by selecting an appropriate material for the valve construction, and by selecting appropriate thicknesses, shapes, and dimensions for various portions of the valve head 28 for the particular valve material and overall valve size. The shape, flexibility, and resilience of the valve head, and in particular, of the petals 52, can be designed or established so that the petals 52 will deflect inwardly when subjected to a sufficient pressure differential that acts across the head 28 in a gradient direction toward the valve interior side (second side 32). Such a pressure differential might occur after a quantity of a substance is discharged through the valve 20, and a partial vacuum is created on the inside of the valve 20. When the valve 20 closes, if there is a partial vacuum in the container, and if the pressure differential across the valve 20 is large enough, the valve petals 52 will deflect inwardly beyond the initial closed position (shown in FIG. 4) to an open configuration so as to permit in-venting of the ambient atmosphere into the container to assist in equalizing the internal pressure with the external pressure. The opening of the valve 20 for such inventing may be characterized as occurring when the valve head openable portions or petals 52 move in a direction toward and to an open configuration. As the external and internal pressures equalize, the inwardly displaced petals 52 will move back out to the initial, closed position (FIGS. 1-4).

It is to be understood that the dispensing orifice of the valve 20 may be defined by structures other than the illustrated straight slits 50. The slits may have various different shapes, sizes and/or configurations in accordance with the dispensing characteristics desired. For example, the orifice may also include four or more intersecting slits.

If it is desired to provide particular dispensing characteristics, then the dispensing valve 20 is preferably configured for use in conjunction with (1) the characteristics or shape of the particular supply reservoir (not shown—but which may establish the maximum height (i.e., static head) of the substance or product in the reservoir), (2) the characteristics of the particular substance or product, and (3) any relevant characteristics of the other dispensing system components. For example, the viscosity and density of the fluent substance product can be relevant factors in designing the specific configuration of the valve 20. The rigidity and durometer of the valve material, and size and shape of the valve head 28, can also be relevant to achieving some desired dispensing characteristics, and can be selected for accommodating the normal range of pressure differential that is expected to be typically applied across the valve head, and for accommodating the characteristics of the substance to be dispensed therefrom.

FIGS. 5-9 illustrate a conventional, prior art fluent substance handling system or dispensing system which has been used for transferring air or liquid from one location to another. In one application of such a prior art system, the system is employed in a juice dispenser wherein a container of juice is mounted in a dispenser base (not illustrated) for dispensing a desired amount of juice when actuated by the user. Such a juice dispenser has a base that typically includes an upwardly projecting conduit or probe similar to the probe 130 illustrated in FIGS. 5-8. The probe 130 includes an internal conduit passage 132 which is open at the probe base. In FIGS. 5-8, the upper end of the probe passage 132 is shown terminating in a cross passage 134 near the upper end of the probe 130. In one modified form of the probe 130 that is not illustrated and which is adapted for use in one specific type of juice dispenser, the cross passage 134 is eliminated, and instead, the passage 132 extends completely longitudinally through the entire length of the probe 130 (i.e., from the base of the probe 130 to the upper end of the probe 130 where the passage 132 would open at the top end of the probe).

The probe 130 is held in the base of the dispenser (or other fluent substance handling system) by suitable conventional or special means (not illustrated), the details of which form no part of the present invention.

Figure 7:
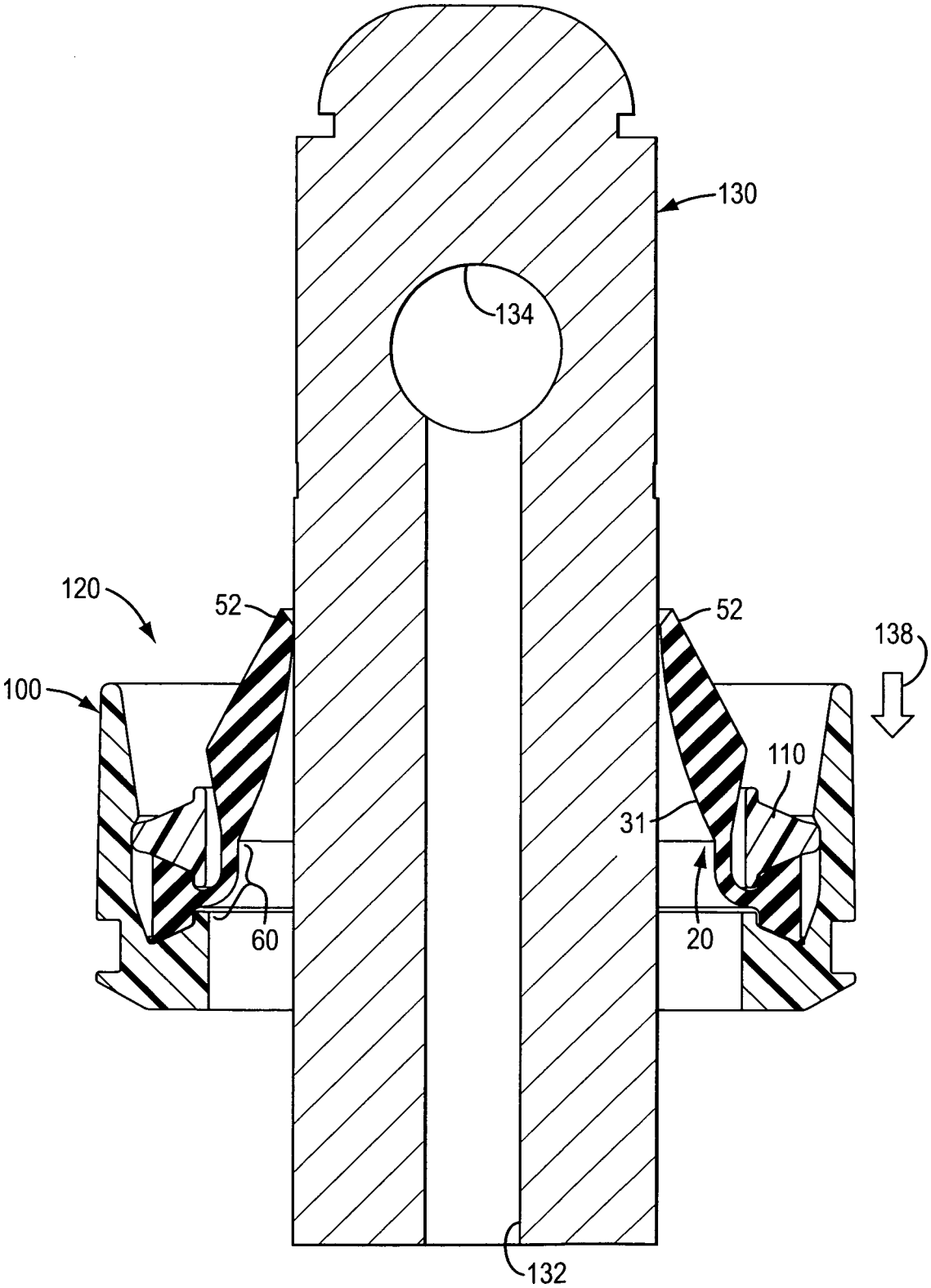
FIG. 7 is an enlarged, cross-sectional view showing the valve and mounting system illustrated in FIGS. 3 and 4 moving down along the probe illustrated in FIGS. 5 and 6.
Figure 8:
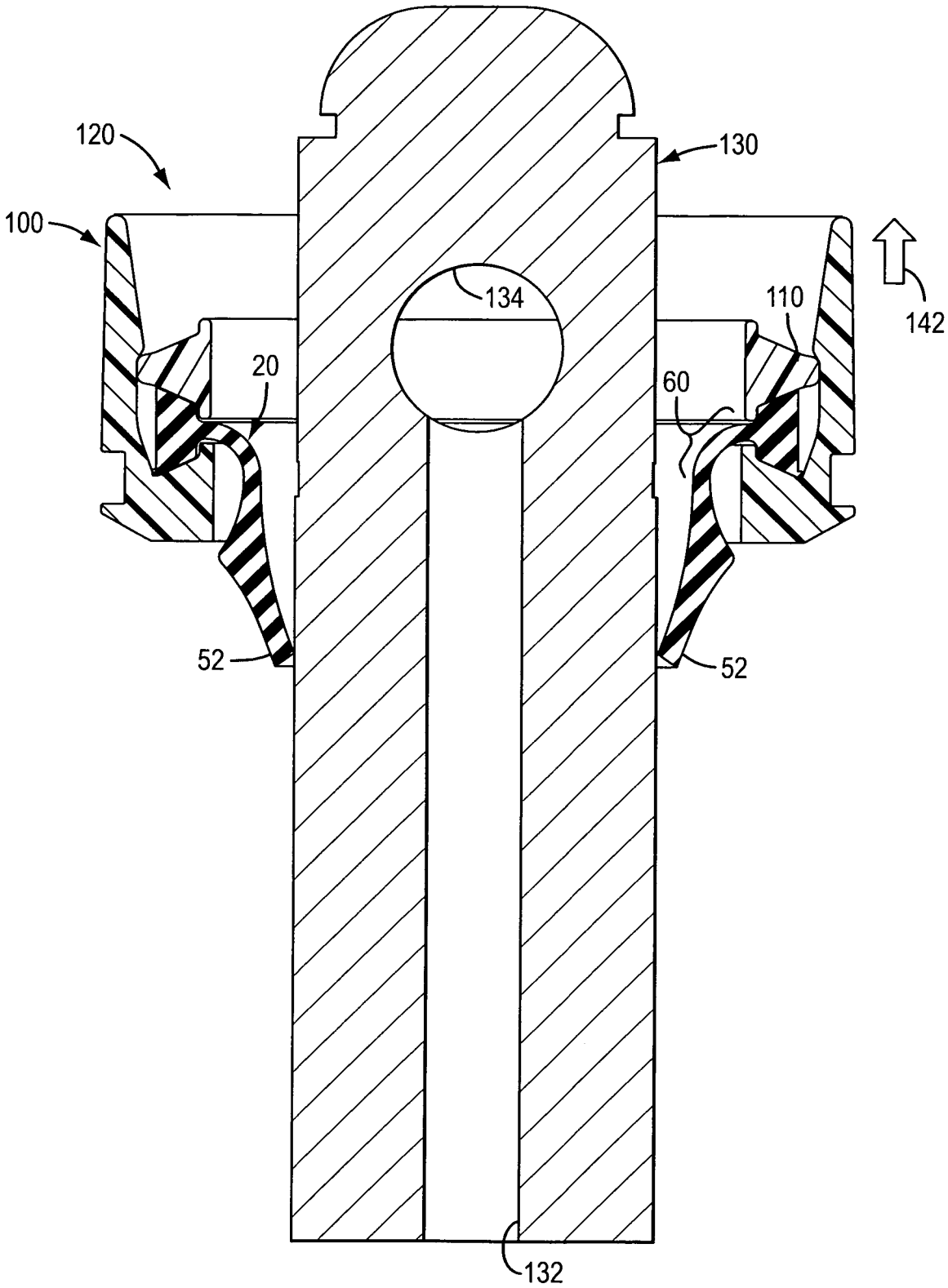
FIG. 8 is a view similar to FIG. 7, but in FIG. 8 the valve and mounting system are shown moving upwardly along the probe.

FIGS. 7 and 8 illustrate how the previously described subassembly 120 (comprising the valve 20, the housing 100, and the retainer ring 110) can be positioned on, and moved relative to, a probe or conduit 130 of a fluent substance handling system, such as a dispensing system. Typically, the subassembly 120 is attached to a fluent substance containment structure, which may be a bottle or container or other device or apparatus containing a fluent substance. In FIGS. 7 and 8, the fluent substance containment structure is not shown. However, in FIGS. 7 and 8, such a fluent containment structure would be attached to the subassembly housing 100 and would extend upwardly from the subassembly 120 so as to define an interior volume into which the upper end of the probe 130 can extend. Such a container, with the subassembly 120 mounted at its opening, is typically inverted and moved downwardly over the probe 130 so that the subassembly 120 becomes positioned below the upper end of the probe 130 (and below the cross passage 134 (or other opening at the upper end of the probe)). In FIG. 7, the downwardly directed arrow 138 shows the direction of movement of the subassembly 120 as it is moved downwardly at the end of the container (not illustrated) along the probe 130. The upper end of the probe 130 initially contacts the valve head first side 31, and sufficient force is exerted by the downwardly moving subassembly 120 to cause the valve head openable portions or petals 52 to be deflected upwardly in a first direction to an open configuration as illustrated in FIG. 7 so as to accommodate the penetration of the probe 130 through the valve 20 and into the interior of the container (not shown). The fluent substance within the container (or other fluent substance containment structure) can flow through the probe (via the passage 134 and 132) and out the bottom of the probe 130 into the dispenser or other portion of an apparatus for further handling, or for further directing the flow of the fluent substance.

From time to time, it may be desirable to remove the fluent substance container (not illustrated) and its attached subassembly 120 from the probe 130. For example, if the fluent substance container (not illustrated) to which the subassembly 120 is mounted has discharged all of its fluent substance contents through the probe 130, it may be desirable to remove the empty container and refill it, or it may be desirable to remove the empty container and replace it with a new, full container with an attached subassembly 120. FIG. 8 illustrates the process of removing the subassembly 120 from the probe 130, but it FIG. 8, the fluent substance container to which the subassembly 120 is mounted has not been shown. As the subassembly 120 moves upwardly, the valve openable portions or petals 52 are dragged downwardly by the frictional engagement of the petals 52 with the exterior surface of the probe 130, and the valve intermediate portion or sleeve 60 essentially rolls through, or bends through, a change in direction of about 180° to the position illustrated in FIG. 8. The valve petals 52 become oriented downwardly along the probe 130. In FIG. 8, the upward movement of the subassembly 120 is indicated by the upwardly directed arrow 142.

Figure 9:
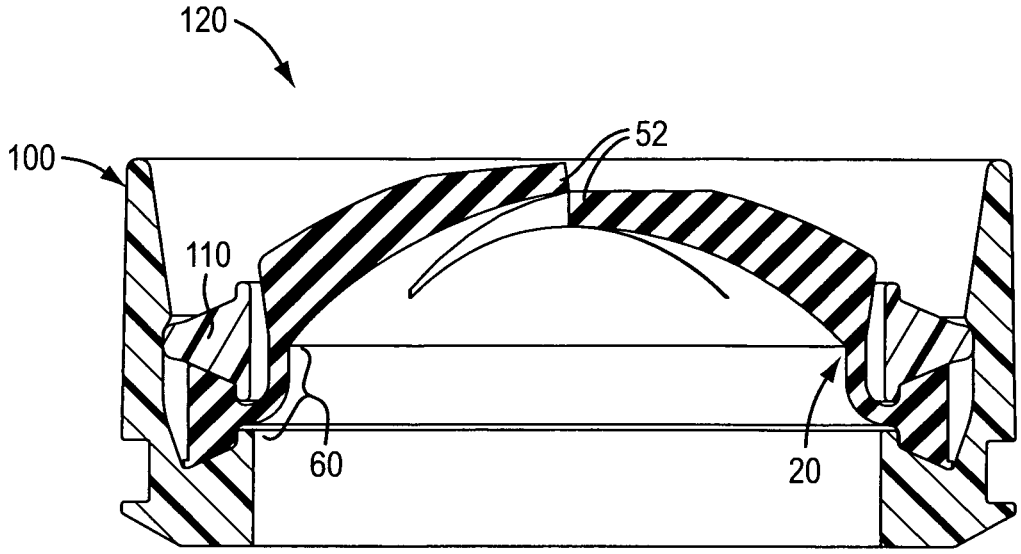
FIG. 9 is a cross-sectional view of the valve and mounting system of FIG. 8 shown after being completely removed from the end of the probe and wherein portions of the valve head have become mis-aligned compared to the closed configuration illustrated in FIG. 4.

The subassembly 120, and the container (not illustrated) in which the subassembly 120 is mounted, are ultimately lifted or moved upwardly high enough so that the valve petals 52 are completely disengaged from the probe 130. At that point, the inherent resiliency of the valve petals 52 and of the intermediate portion or sleeve 60 causes the petals 52 and sleeve 60 to move back toward the initially closed orientation (FIG. 4). However, sometimes the petals 52 do not properly realign themselves in the initially closed condition shown in FIG. 4, and instead, become misaligned as shown in FIG. 9. This has been found to more frequently occur if the probe 130 has a relatively large diameter compared to the diameter of the valve 20. The misalignment of the petals 52 as illustrated in FIG. 9 can lead to inadequate valve closure, and this can result in a slight leakage through the valve 20.

It has occurred to the inventor of the present invention that the above-discussed tendency of the valve petals 52 to become misaligned could be overcome, not by changing the valve design, per se, as might be expected, but instead by providing a unique valve mounting system. It has also occurred to the inventor of the present invention that a flexible, resilient valve could be incorporated with a valve mounting system in a container or bottle of water for use in a water dispenser of the type generally referred to as a "water cooler."

The inventor of the present invention has also discovered that the valve petal misalignment problem discussed above and illustrated in FIG. 9 can be substantially overcome, if not completely eliminated, for a valve in a water cooler system or other fluent substance handling system by providing a special valve mounting system with an abutment structure not heretofore disclosed or suggested in the prior art.

The conventional water dispenser or water cooler includes a base or stand on which a glass or plastic bottle of drinking water is inverted over an upwardly projecting probe (such as the probe 130). The bottle of water initially contains a number of gallons of water (e.g., five gallons). Initially, a small amount of the water flows out from the inverted water bottle through the probe 130 into a cooling reservoir in the base, and the cooled water can then be discharged from the base when the user presses a button or lever on the base to open a discharge spout in the base for filling a cup or glass.

Figure 10:
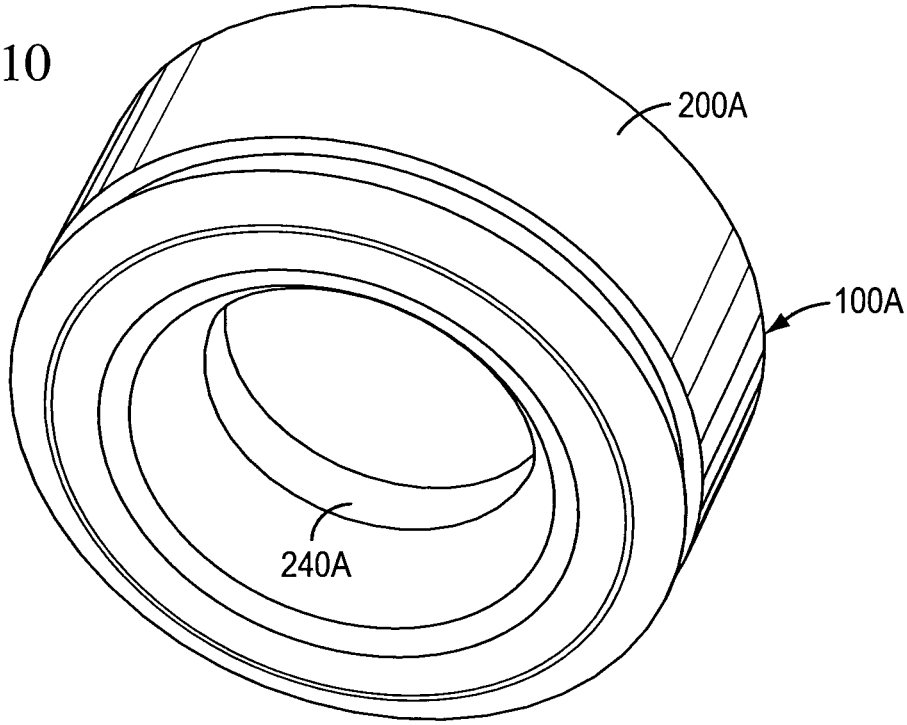
FIG. 10 is an isometric view of a housing forming part of the mounting system of the present invention.
Figure 11:
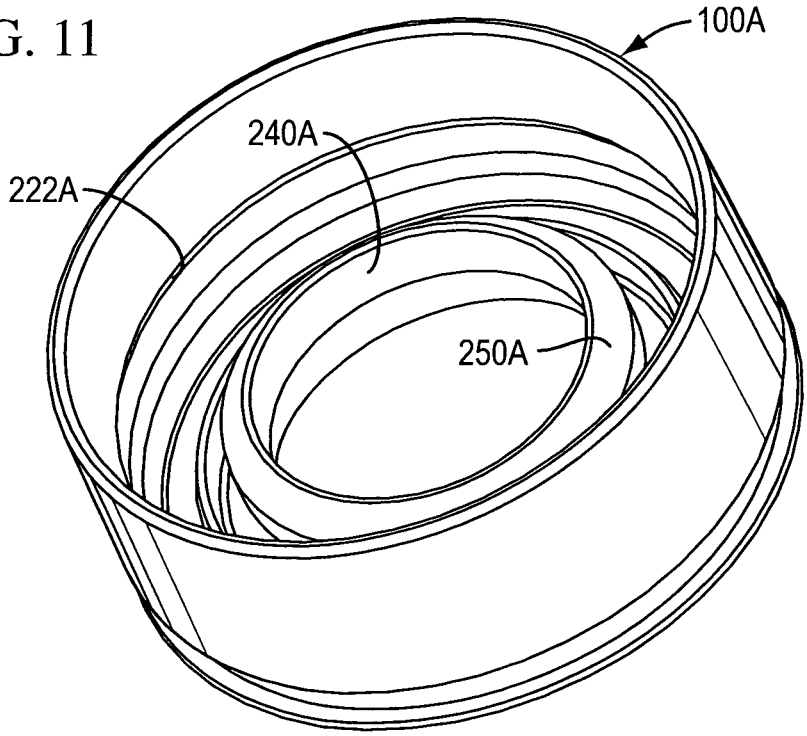
FIG. 11 is an isometric view of the housing shown in FIG. 10, but in FIG. 11, the housing is viewed from a different angle to show interior detail.

In a presently preferred embodiment of the valve mounting system of the present invention, the special abutment structure is formed as a unitary part of an improved housing 100A illustrated in FIGS. 10, 11, 13, 14, and 15. As can be seen in FIGS. 10, 11, and 13, the housing 100A has a generally annular configuration around a through passage. As explained hereinafter in detail, the housing 100A incorporates part of a retention structure for engaging and holding a valve, such as the valve 20 described above with reference to FIGS. 1-2.

With reference to FIGS. 10 and 11, the housing 100A includes a generally cylindrical exterior wall 200A. As can be seen in FIG. 13, the interior surface of the wall 200A includes an inwardly extending bead or shoulder 220A which is substantially identical to the bead 122 described above with reference to the prior art housing 100 illustrated in FIG. 4.

As can be seen in FIG. 13, at the bottom of the housing annular wall 200A there is an inwardly extending, frustoconical seating surface or seat 106A which is substantially identical to the seat 106 described above with reference to the prior art housing 100 illustrated in FIG. 4.

As shown in FIG. 13, the housing 100A is adapted to hold a valve, such as the previously described valve 20, by means of snap-fit-engagement with the retainer ring 110 in the same manner as described above with respect to the retainer ring 110 and valve 20 illustrated in FIG. 4.

At the bottom, inside region of the housing annular wall 200A there is a special abutment structure 240A (FIG. 13). The abutment structure 240A is preferably formed as a unitary extension of, or part of, the housing 100A. In the preferred embodiment, the abutment structure 240A is configured to be disposed adjacent the intermediate portion 60 of the valve 20. Further, in the preferred form of the present invention, the abutment structure 240A is a flange having an arcuate configuration in cross section (as viewed in FIG. 13). The abutment structure or flange 240A has a distal end defining a frustoconical abutment surface 250A (FIGS. 11 and 13). As can be seen in FIG. 13, the frustoconical abutment surface 250A is positioned to confront the laterally marginal portion 55 of the valve head first side 31—preferably at a location adjacent an end of the slits 50 (FIG. 13).

The combination of the retainer ring 110 and housing 100A comprises one form of a preferred mounting system of the present invention. In this preferred form of the mounting system of the present invention, the "retention structure" for engaging and holding the valve 20 includes (1) the retainer ring 110, and (2) at least a portion of the housing 100A which defines the seat or clamping surface 106A. The valve 20 could have other configurations, such as a different shape for the mounting flange 86. Also, in some other arrangements, the valve 20 could be held in a housing without a retainer ring. For example, the valve could be held in the housing by heat bonding, swaging of a wall of the housing over the valve flange, adhesive, press fit, etc. The details of the particular design for holding the valve in the housing form no part of the broad aspects of the present invention.

When the valve 20 is properly mounted within the housing 100A and retained therein with the retainer ring 110 (or by other suitable conventional of special means), the assembly of the components may be regarded as a subassembly 120A (FIG. 13).

The subassembly 120A is especially suitable for use with a water dispenser or water cooler. The subassembly 120A can be installed in the neck of a plastic or glass bottle (not illustrated, but typically containing about 5 gallons of water). The subassembly 120A can be press fit into the bottle neck or retained therein by other suitable conventional or special means (e.g., adhesive, snap-fit, etc.), the details of which form no part of the present invention. The distal end of the bottle-neck can be hermetically sealed with a removable and discardable seal (not illustrated) to keep the end of the bottle neck (and the inserted subassembly 120A) clean and undamaged. When it is desired to install such a water bottle in the base of a water dispenser over a probe (such as the probe 130 illustrated in FIGS. 14 and 15), the seal can be removed. Then the bottle can be inverted. The valve 20 has sufficient resilience and strength to withstand the static head or weight of the water in the inverted bottle so that the water does not leak out of the bottle as the bottle is being inverted and positioned above the water dispenser base prior to installation over upwardly projecting the probe in the water dispenser base.

Figure 14:
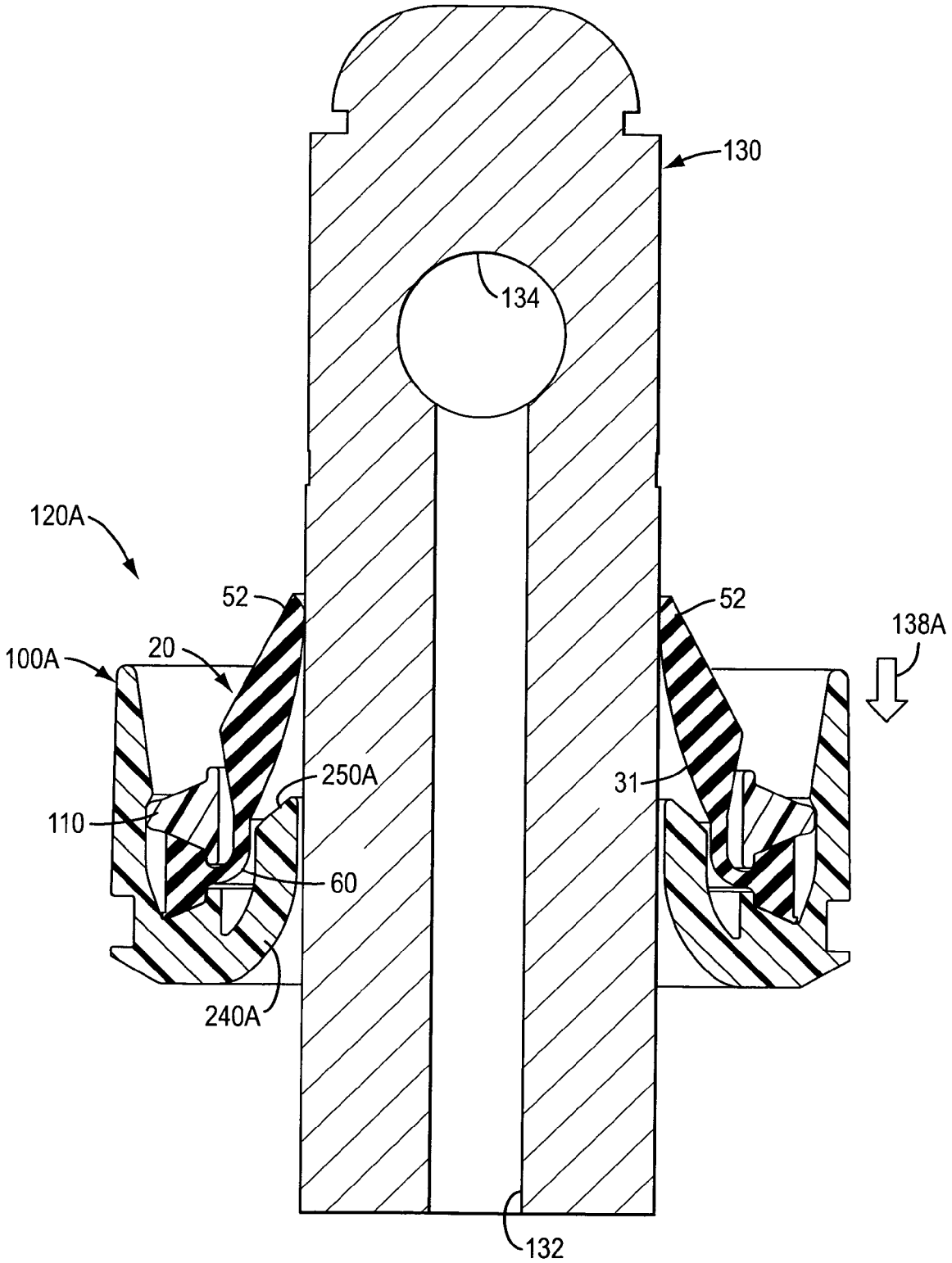
FIG. 14 is a cross-sectional view of the valve and mounting system illustrated in FIG. 13.

FIG. 14 corresponds generally to FIG. 7 discussed above, but in FIG. 14 the inventive mounting system is shown moving downwardly along the probe 130. Such movement occurs as the valve 20 is carried downwardly in the subassembly 120A mounted in the opening of an inverted fluid substance container (not illustrated) that is being lowered over the upper end of the probe 130. The downward movement of the subassembly 120A is indicated in FIG. 14 by the downwardly directed arrow 138A. As the valve 20 is carried downwardly as part of the subassembly 120A, the valve petals or openable regions 52 are deflected upwardly by the probe engaging the first side 31 of the valve head. The valve openable portions or petals 52 can be said to move in a "first direction" to an open configuration around the probe 130 as viewed in FIG. 14.

The open petals 52 accommodate the penetration of the upper end of the probe 130 into the interior of a container (not illustrated) on which the subassembly 120A is mounted. The petals 52 seal around the periphery of the probe 130 in a substantially liquid-tight manner. The fluent substance, such as a liquid or gas, can enter into the probe 130 through the passages 134 and 132, then exit from the bottom of the probe 130, and then flow into other portions of the dispensing system for holding, dispensing, or further processing.

When it is desired to remove the container or other fluid containment structure from the probe 130, the container or other fluid containment structure (with the subassembly 120A attached thereto), can be pulled upwardly off of the probe 130. For example, in a water dispenser or water cooler, after the bottle of water has been emptied through normal dispensing use of the water cooler, it may be desirable to remove the empty bottle and replace the empty bottle with another, full bottle.

Figure 15:
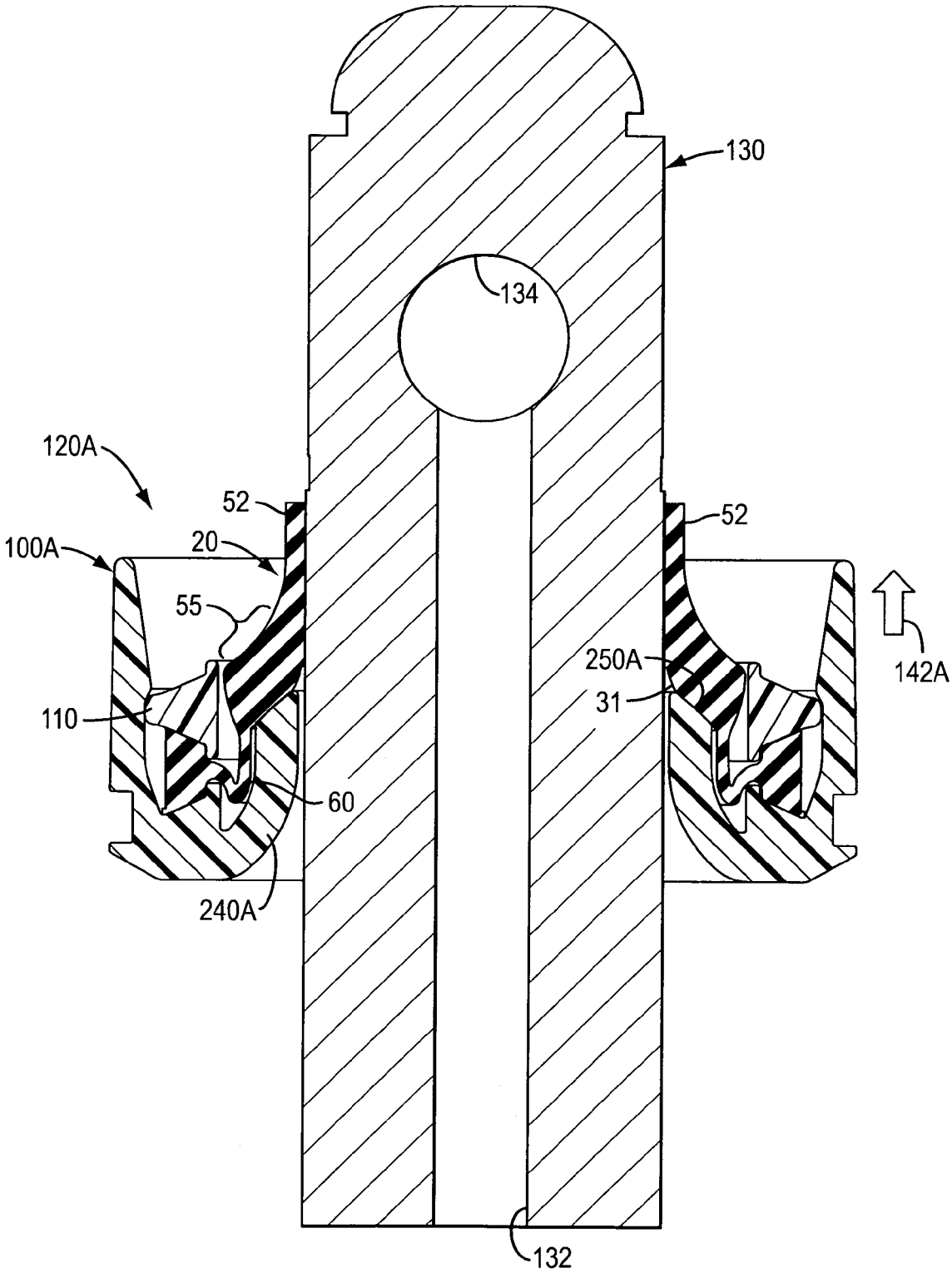
FIG. 15 is a view similar to FIG. 14, but FIG. 15 illustrates the valve and mounting system moving upwardly along the probe.

FIG. 15 illustrates the upward movement of the subassembly 120A along the probe 130 (as the subassembly 120A would be carried upwardly with the container (not illustrated) or other fluent substance containment structure to which the subassembly 120A would be mounted is not shown in FIG. 15). The upward movement of the subassembly 120A in FIG. 15 is indicated by the direction arrow 142A. As the valve 20 is carried upwardly in the subassembly 120A, the valve petals 52 are frictionally engaged with the exterior surface of the probe 130, and this applies a downward force to the petals 52. However, the petals 52 can move downwardly only a slight amount until the valve head first side 31 is engaged at the laterally marginal portion 55 of the valve head by the surface 250A of the abutment structure or flange 240A. This restricts or limits the movement of the laterally marginal portion 55 of the valve head in the second direction (downwardly). This prevents the head of the valve 20 and the valve intermediate portion or sleeve 60 from being moved downwardly to the other open position as occurred in the prior art subassembly 120 described above with reference to FIG. 8. Owing to the limitation of the downward movement of the valve laterally marginal portion 55, the valve petals 52 are not dragged past each other as the subassembly 120A moves upwardly and clears the upper end of the probe 130. The inventor has discovered that this permits the valve petals 52 to close in substantially correct and proper alignment to establish a leak-tight seal as illustrated in FIG. 13.

The mounting system of the present invention may be used to mount other resilient, flexible valves that have configurations different from the configuration of the valve 20 described above so long as the other valve has a valve head with at least one slit, an intermediate portion extending from the valve head, and a peripheral attachment portion at the end of the intermediate portion.

Further, in some other fluent substance handling systems (not illustrated), the valve mounting system may remain stationary while the conduit or probe is moved relative to the valve (i.e., while the probe is inserted or withdrawn).

It will be readily observed from the foregoing detailed description of the invention and from the illustrations thereof that numerous other variations and modifications may be effected without departing from the true spirit and scope of the novel concepts or principles of this invention.

What is claimed is:

1. A mounting system for mounting a valve for accommodating flow of a substance from a supply of the substance, wherein said valve includes:

(1) a peripheral attachment portion;

(2) a flexible, resilient, intermediate portion extending from said peripheral attachment portion; and (3) a flexible, resilient head that extends from said intermediate portion, and that has (a) a first side, (b) a second side, (c) at least two self-sealing slits through said head, (d) a laterally marginal portion adjacent said intermediate portion, and (e) at least three confronting, openable portions along said slits to define an initially closed orifice wherein said valve head openable portions can move to an open configuration, the head being thicker in transverse cross section than the intermediate portion;

said mounting system comprising:

(A) a retention structure to engage and hold said valve peripheral attachment portion;

(B) an annular flange located to extend over at least a portion of said valve intermediate portion adjacent said laterally marginal portion of the flexible resilient head;

a unitary housing defining said annular flame and at least part of said retention structure, said housing defines a through passage, and said valve is initially separate from, but subsequently attachable to, said housing across said through passage; and wherein said flow of said substance from said supply is via a probe that selectively penetrates said valve, and said annular flange includes a probe directing surface sloped toward said valve head as said surface extends inward radially.

2. The system in accordance with claim 1, wherein said retention structure further includes a retainer ring in snap-fit engagement with said housing to clamp said valve between said retainer ring and a portion of said housing.

3. The system in accordance with claim 1, wherein said annular flange is sized to extend over all of said valve intermediate portion and located to be engaged by said valve head first side at said laterally marginal portion of said valve head to limit movement of said laterally marginal portion of said valve head in said second direction.

4. The system in accordance with claim 1, in which said annular flange extends around said through passage;

said annular flange has an arcuate configuration in transverse cross section; and said annular flange has a distal end defining a frustoconical abutment surface for being engaged by said valve first side at said laterally marginal portion of said valve head.

5. The system in accordance with claim 4, in which said frustoconical abutment surface of said annular flange is positioned to confront said laterally marginal portion of said valve head first side at a location adjacent an end of said slit.

* * * * *